US009951510B2

(12) United States Patent
Lee

(10) Patent No.: US 9,951,510 B2
(45) Date of Patent: Apr. 24, 2018

(54) JOINT STRUCTURE OF STEEL BEAM

(71) Applicants: Samsung C & T Corporation, Seoul (KR); SEN CORETECH CO., LTD., Seoul (KR)

(72) Inventor: Chang Nam Lee, Seoul (KR)

(73) Assignees: SAMSUNG C & T CORPORATION, Seoul (KR); SEN CORETECH CO., LTD., Seoul (KR)

( * ) Notice: Subject to any disclaimer, the term of this patent is extended or adjusted under 35 U.S.C. 154(b) by 0 days.

(21) Appl. No.: 15/542,036

(22) PCT Filed: Nov. 24, 2015

(86) PCT No.: PCT/KR2015/012618
§ 371 (c)(1),
(2) Date: Jul. 6, 2017

(87) PCT Pub. No.: WO2016/111458
PCT Pub. Date: Jul. 14, 2016

(65) Prior Publication Data

US 2018/0002914 A1 Jan. 4, 2018

(30) Foreign Application Priority Data

Jan. 6, 2015 (KR) ..... 10-2015-0001182

(51) Int. Cl.
*E04B 1/24* (2006.01)
*E04B 1/41* (2006.01)
*E04B 1/38* (2006.01)

(52) U.S. Cl.
CPC ..... *E04B 1/2403* (2013.01); *E04B 1/40* (2013.01); *E04B 2001/2415* (2013.01);
(Continued)

(58) Field of Classification Search
CPC .. E04B 1/2403; E04B 1/40; E04B 2001/2451; E04B 2103/06;
(Continued)

(56) References Cited

U.S. PATENT DOCUMENTS 3,047,110 A * 7/1962 Saha ..... E04B 1/58 403/189
3,938,297 A * 2/1976 Sato ..... E04B 1/2403 403/188
(Continued)

FOREIGN PATENT DOCUMENTS

JP 2012-107416 A 6/2012
JP 2013-253367 A 12/2013
(Continued)

*Primary Examiner* — Rodney Mintz
(74) *Attorney, Agent, or Firm* — Rabin & Berdo, P.C.

(57) ABSTRACT

In a joint structure of steel beam structure, a bracket is coupled and fixed to the lateral side of a large beam or a pillar and a steel beam is coupled to the bracket such that the steel beam is coupled to the lateral side of the large beam or the pillar. One end of the bracket is coupled to the lateral side of the large beam or the pillar, and the other end is inclined such that the lower part thereof forms an acute angle, wherein a first attachment plate is coupled to the inclined end part of the bracket such that a fixed length thereof protrudes from the upper end of the bracket. The lower part of one end of the steel beam is inclined at an obtuse angle so as to correspond to the other inclined end of the bracket.

7 Claims, 18 Drawing Sheets

(52) U.S. Cl.
CPC ..... *E04B 2001/2451* (2013.01); *E04B 2001/2457* (2013.01); *E04B 2001/405* (2013.01); *E04B 2103/06* (2013.01)

(58) Field of Classification Search
CPC ..... E04B 2001/2415; E04B 2001/2457; E04B 2001/405; E04B 1/58
See application file for complete search history.

(56) References Cited

U.S. PATENT DOCUMENTS 4,014,089 A * 3/1977 Sato ..... E04B 1/2403 228/138
4,091,594 A * 5/1978 Yamashita ..... E04B 1/2403 52/283
4,111,578 A * 9/1978 Sato ..... E04B 1/2403 403/189
5,688,069 A * 11/1997 Hoshino ..... E04B 1/215 403/333
5,827,006 A * 10/1998 Hoshino ..... E04B 1/215 403/333
6,059,482 A * 5/2000 Beauvoir ..... E04B 1/2403 403/187
6,073,405 A * 6/2000 Kasai ..... E04B 1/2403 403/270
6,474,902 B1 * 11/2002 Beauvoir ..... E04B 1/2403 403/187
6,739,099 B2 * 5/2004 Takeuchi ..... E04B 1/2403 403/403
7,793,981 B2 * 9/2010 Xie ..... B62D 21/02 280/785
9,097,003 B1 * 8/2015 Sultan ..... B64C 1/069
9,394,679 B2 * 7/2016 Tanaka ..... E04B 1/2403
2008/0035814 A1 * 2/2008 Xie ..... B62D 21/02 248/228.1
2009/0007520 A1 * 1/2009 Navon ..... E04B 7/022 52/837
2014/0083042 A1 * 3/2014 Hiragaki ..... F16B 7/182 52/655.1
2014/0338280 A1 * 11/2014 Tanaka ..... E04B 1/2403 52/655.1
2015/0167299 A1 * 6/2015 Trubnikow ..... E04B 1/36 52/848

FOREIGN PATENT DOCUMENTS

KR 10-2002-0063779 A 8/2002
KR 10-0430317 B1 5/2004
KR 10-2006-0071525 A 6/2006
KR 10-2012-0003342 A 1/2012
KR 10-2014-0098524 A 8/2014

* cited by examiner (a)

(b)

(a)

(b)

(c)

(d)

(e)

(a)

(b)

(a)

(b)

(a)

(b)

(a)

(b)

JOINT STRUCTURE OF STEEL BEAM

TECHNICAL FIELD

The present invention relates to a joint structure of steel beam for connecting a steel beam to the side surface of a steel column or girder, and more particularly, to a joint structure of steel beam that is capable of effectively transferring a shear force on the connected surfaces between a steel beam and a bracket, through a simple configuration, thereby remarkably reducing the number of bolts needed.

BACKGROUND ART

A steel structure having main structural members like columns, beams and so on, which are made of steel, is adequate for high-rise and long-span structures and has excellent earthquake resistance and constructability because of the high strength steel used therefor, so that the steel structure has been widely used.

The columns or beams constituting the steel structure are generally manufactured in advance in a factory according to their designed sizes under their designed stress, and next, the steel beams are coupled to the columns in construction site.

In conventional practice, as shown in FIG. 1, a bracket 4 is integrated with a steel column 1 and then connected to a steel beam 3 so as to connect the steel beam 3 to the steel column 1. When the bracket 4 is connected to the steel beam 3, as shown, eight slice plates PL are mounted on the top and underside surfaces of the upper and lower flanges of the bracket 4 and the steel beam 3 and both surfaces of the webs of the bracket 4 and the steel beam 3 and then fastened thereto by means of bolts B.

Accordingly, bolt coupling holes should be punched on the steel beam 3, and in this case, the machining cost for the steel beam 3 is very expensive. In more detail, the punching work itself is simple, but handling costs for lifting and fixing the heavy steel beam 3 are much needed. In this case, the number of bolt coupling holes of the bracket 4 is the same as of the steel beam 3, but the machining cost for the heavy steel beam 3 is higher than that for the bracket 4.

The number of bolts B needed on the bracket 4 is the same as needed on the steel beam 3, so that the number of bolts needed for moment transmission becomes double.

Accordingly, the conventional joint structure of steel beam as shown in FIG. 1 undesirably requires many bolts B, which is very disadvantageous in view of the period of construction and the construction cost thereof.

Further, since the slice plates PL are fixed to the top and underside surfaces of the upper and lower flanges of the bracket 4 and the steel beam 3 and both surfaces of the webs of the bracket 4 and the steel beam 3, at least a party of two workers is needed to connect the bracket 4 to the steel beam 3, and in the step of temporarily fastening the slice plates PL to the bracket 4 or the steel beam 3 in high altitude, safety accidents caused by falls of the slice plates PL or bolts B may happen.

Furthermore, the conventional joint structure of steel beam as shown in FIG. 1 is applied only when the H beam 3 is coupled to the H steel bracket 4, so that it is impossible to conduct the connection of a composite steel beam like a TSC (T-type Steel Concrete) beam.

When a deck plate is installed, in addition, the portions where the slice plates PL are located protrude from the top of the upper flange of the steel beam 3, so that separate plates are welded to the sides of the upper flanges of the bracket 4 and the steel beam 3 on the slice plates PL and the deck plate is then installed on the welded plates, thereby undesirably needing the separate plate welding work.

So as to solve the above-mentioned problems, as shown in FIG. 2, a steel beam 3 is connected directly to the side surface of a steel column 1 by means of tension bolts as fastening means.

Because of a construction error, in this case, the steam beam 3 has a shorter length than clear spacing of the steel column 1, so that shim plates SP are fittedly inserted into gaps occurring between the steel beam 3 and the steel column 1 in construction site.

However, the gaps between the steel beam 3 and the steel column 1 are varied in size according to their construction environment. Accordingly, the shim plates SP having various thicknesses are first prepared, and they should be selected and fitted to the gaps one by one. Moreover, it is impossible to insert the shim plates SP on a weak axis of the steel column 1.

Furthermore, there is proposed a conventional method wherein the end portions of a bracket and a steel beam are slanted correspondingly to each other to remove a construction error (which is disclosed in Korean Patent Application Laid-open No. 10-2006-0071525).

According to the conventional technique, however, bent plates for connecting a web and a beam are complicatedly manufactured and connected.

Further, bolts of the web just connect and fix adjacent members, but they cannot transfer a moment. Accordingly, welding work for adjacent upper and lower flanges is needed in construction site, which causes degradation in the quality of the connection structure and safety accidents.

DISCLOSURE

Technical Problem

Accordingly, the present invention has been made in view of the above-mentioned problems occurring in the prior art, and it is an object of the present invention to provide a joint structure of steel beam that is configured wherein the connection surfaces between a steel beam and a bracket are formed slantly, so that the shear force on the connection surfaces between the steel beam and the bracket can be effectively transferred through a simple structure having no welding carried out in construction site.

It is another object of the present invention to provide a joint structure of steel beam that is configured wherein there is no need to transfer shear force through bolts because the shear force is effectively transferred through only tension bolts, thereby greatly reducing the number of bolts needed for the connection.

It is yet another object of the present invention to provide a joint structure of steel beam that is configured wherein there are no gaps caused upon the connection of a steel beam, thereby in advance preventing the problems caused due to the insertion of shim plates into the gaps.

It is still another object of the present invention to provide a joint structure of steel beam that is capable of achieving precise construction upon the connection of a steel beam, thereby improving the quality of the connected portion of the steel beam.

Technical Solution

To accomplish the above-mentioned objects, according to the present invention, there is provided a joint structure of steel beam for fixedly connecting a bracket to the side surface of a column or girder and a steel beam to the bracket so that the steel beam is connected to the side surface of the column or girder, the structure including: the bracket having one end coupled to the side surface of the column or girder and the other end whose lower portion formed slantly to an acute angle; a first connection plate coupled to the slant end portion of the bracket in such a manner as to protrude from the top of the bracket by a given length; the steel beam having one end whose lower portion formed slantly to an obtuse angle in such a manner as to correspond to the slant other end of the bracket; and a second connection plate coupled to the slant end portion of the steel beam in such a manner as to protrude from the top of the steel beam by a given length, wherein the first connection plate has a pair of guide parts protruding from the steel beam side lower portion thereof in such a manner as to be spaced apart from each other, and the second connection plate has chamfered portions formed on both sides of the lower end thereof in such a manner as to allow the lower end thereof to be inserted into the pair of guide parts; and each of the bracket and the steel beam has an upper flange, a lower flange and a web connecting the upper flange and the lower flange with each other, so that the bracket and the steel beam are connected to each other by fastening the first connection plate and the second connection plate to each other by means of tension bolts TB above and under the upper flanges of the bracket and the steel beam to transfer tension forces between the upper flanges.

According to the present invention, desirably, the bracket is an H beam.

According to the present invention, desirably, the steel beam is an H beam or a composite beam made by bending steel plates to charge concrete into the bent steel plates.

According to the present invention, desirably, the lower portions of the first connection plate and the second connection plate are fastened to each other by means of tension bolts for lateral force resistance.

According to the present invention, desirably, each guide part includes a bolt member coupled to the rear surface of the first connection plate in such a manner as to protrude from the front surface of the first connection plate and a pipe member having a screw thread formed at the inside thereof in such a manner as to be screw-coupled to the protruding portion of the bolt member.

According to the present invention, desirably, the guide parts are formed of plates coupled to the corners of the lower portion of the front surface of the first connection plate in such a manner as to be inclined inwardly toward the lower portion thereof to correspond to the chamfered portions of the lower end of the second connection plate.

According to the present invention, desirably, the first connection plate and the second connection plate protrude from the sides of the bracket and the steel beam by a given length, and reinforcement plates are coupled to the spaces between the sides of the upper flanges of the bracket and the steel beam and the protruding portions of the first connection plate and the second connection plate from the sides of the bracket and the steel beam.

Advantageous Effects

The joint structure of steel beam of the present invention has the following advantages.

Firstly, the first connection plate and the second connection plate are coupled correspondingly to the end portions of the bracket and the steel beam and then fastened to each other by means of the tension bolts above and under the upper flanges of the bracket and the steel beam, so that since a shear force on the connection surfaces between the steel beam and the bracket can be effectively transferred, there is no need to transfer shear force through bolts, thereby greatly reducing the number of bolts for the connection, and the slanted connection surfaces are just fastened to each other by means of only the tension bolts, thereby improving economical effects and constructability, shortening the period of construction, and ensuring the safety in construction because no welding is carried out in construction site.

Secondly, since the bolts transfer only tension forces, bolt coupling holes may be free in size, so that the manufacturing and construction errors generated upon the connection of the steel beam can be controlled through the bolt coupling holes.

Thirdly, even at a portion at which a moment is large, the bracket and the steel beam can be freely connected to each other, so that the length of the bracket can be freely adjusted to remove delivery and lifting loads caused by the increment in the length of the bracket.

Fourthly, since the first connection plate and the second connection plate come into completely close contact with each other, precise construction can be achieved, without any separate shim plates, so that there is no other member between the first connection plate and the second connection plate, thereby stably transferring a bending moment therebetween.

Fifthly, the H bracket can be easily connected to the H column or girder in every direction of the H column or girder.

Sixthly, the chamfered portions formed on the second connection plate are inserted into the pair of guide parts formed on the first connection plate, which accurately guides the connected positions between the bracket and the steel beam upon the construction.

Seventhly, since the first connection plate and the second connection plate are fastened to each other by means of the tension bolts to connect the bracket and the steel beam, there is no need to punch the bolt coupling holes on the steel beam, so that the machining cost for the steel beam can be saved.

Eighthly, the steel beam may have various sectional shapes, such as the H beam, TSC composite beam and the like.

Lastly, since the portions of the first connection plate and the second connection plate protrude from the top of the steel beam, a deck plate can be installed, without any separate welded plate in construction site, if the deck plate is cut off by the protruding portions, and further, the protruding portions of the first connection plate and the second connection plate may be buried in slab concrete, so that they may serve as shear connectors.

BEST MODE FOR INVENTION

To accomplish the above-mentioned objects, according to the present invention, there is provided a joint structure of steel beam for fixedly connecting a bracket to the side surface of a column or girder and a steel beam to the bracket so that the steel beam is connected to the side surface of the column or girder, the joint structure of steel beam including: the bracket having one end coupled to the side surface of the column or girder and the other end whose lower portion formed slantly to an acute angle; a first connection plate coupled to the slant end portion of the bracket in such a manner as to protrude from the top of the bracket by a given length; the steel beam having one end whose lower portion formed slantly to an obtuse angle in such a manner as to correspond to the slant other end of the bracket; and a second connection plate coupled to the slant end portion of the steel beam in such a manner as to protrude from the top of the steel beam by a given length, wherein each of the bracket and the steel beam has an upper flange, a lower flange and a web connecting the upper flange and the lower flange with each other, so that the bracket and the steel beam are connected to each other by fastening the first connection plate and the second connection plate to each other by means of tension bolts above and under the upper flanges of the bracket and the steel beam.

MODE FOR INVENTION

Hereinafter, an explanation on a joint structure of steel beam according to the present invention will be in detail given with reference to the attached drawing.

Figure 1:
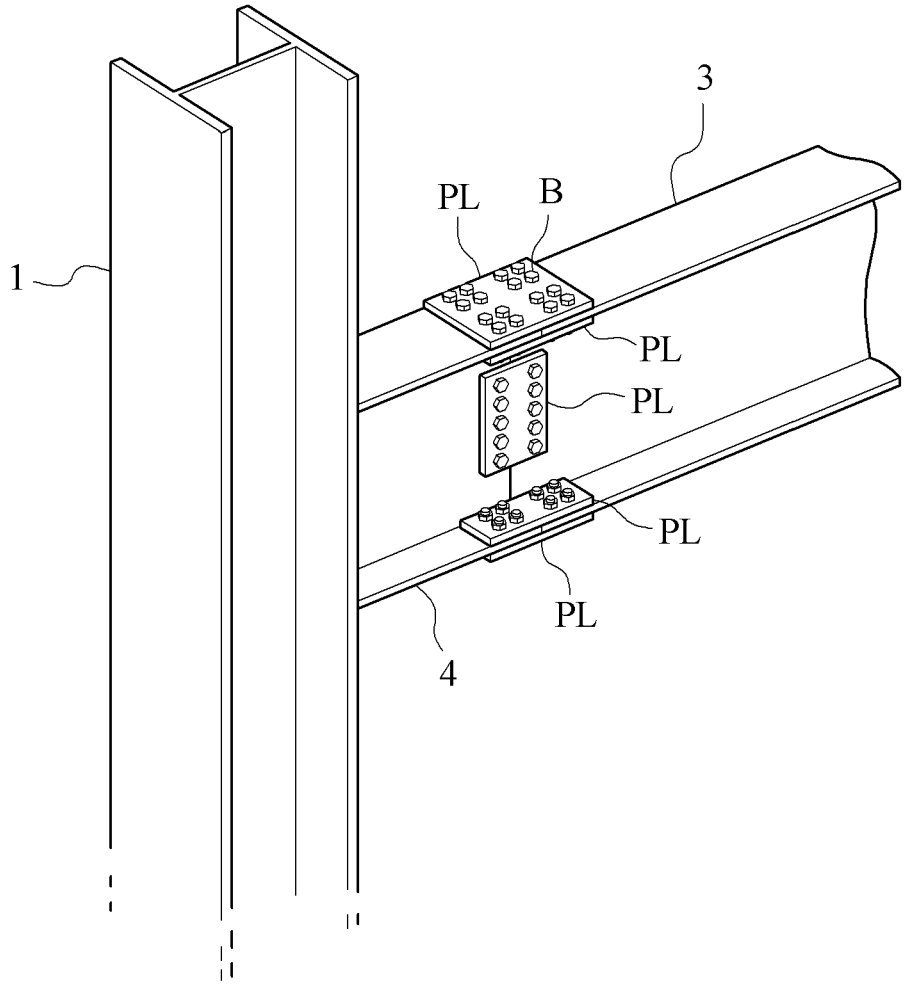
FIG. 1 PRIOR ART
FIGS. 1 and 2 are perspective views showing conventional connection structures between a steel beam and a steel column.
Figure 2:
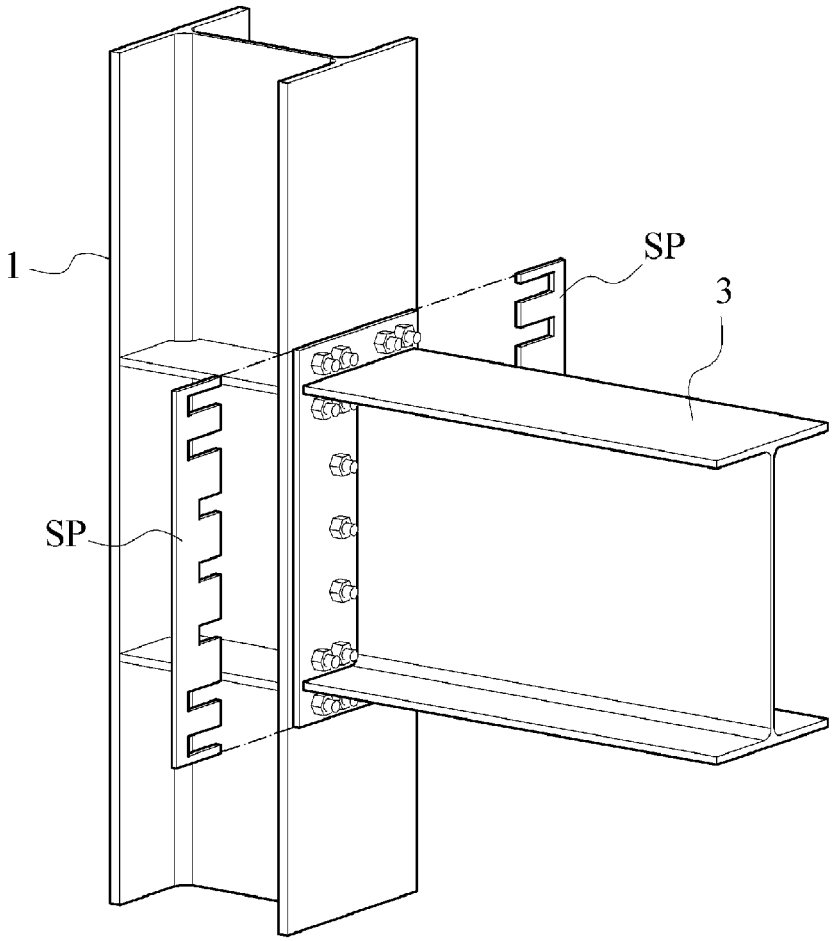
FIG. 2 PRIOR ART
Figure 3:
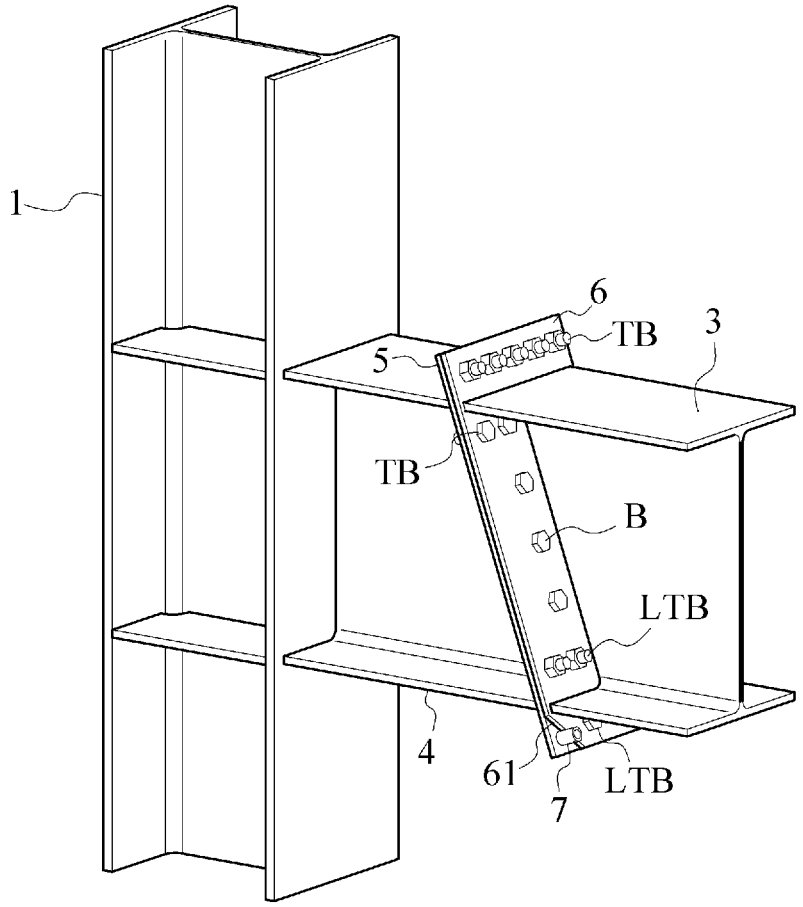
FIG. 3 is a perspective view showing a joint structure of steel beam according to the present invention.
Figure 4:
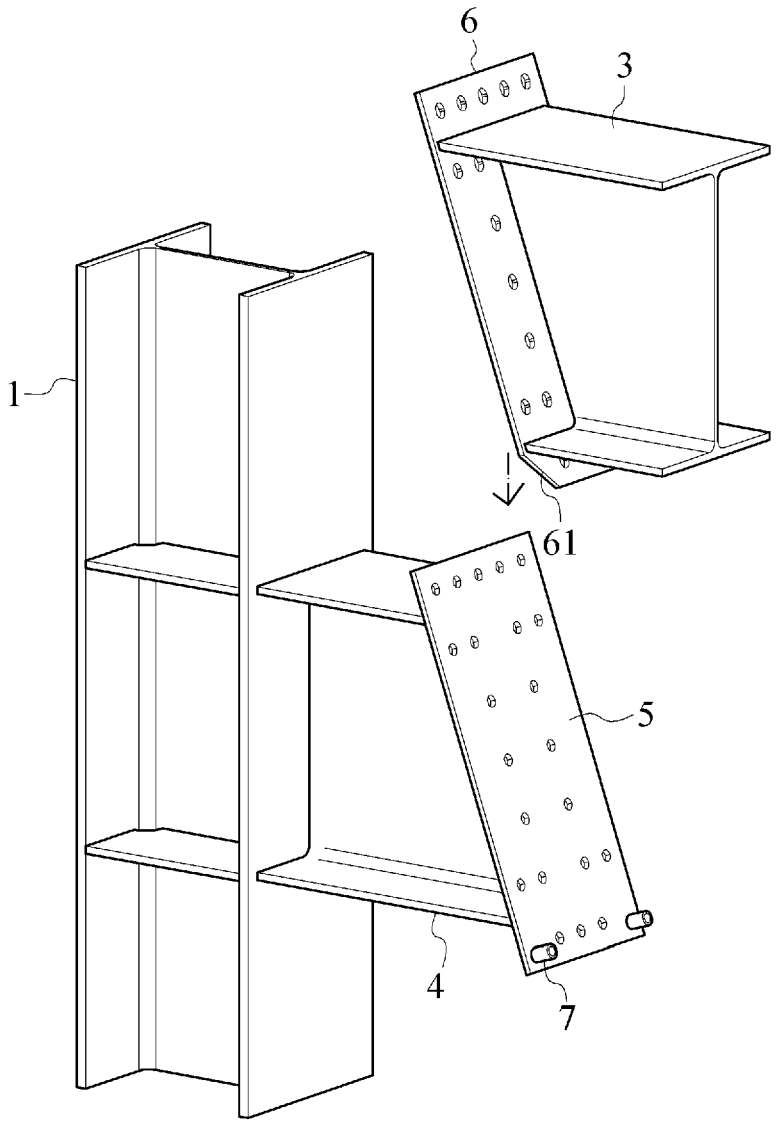
FIG. 4 is a perspective view showing steel beam connection in the joint structure of steel beam according to the present invention.
Figure 5:
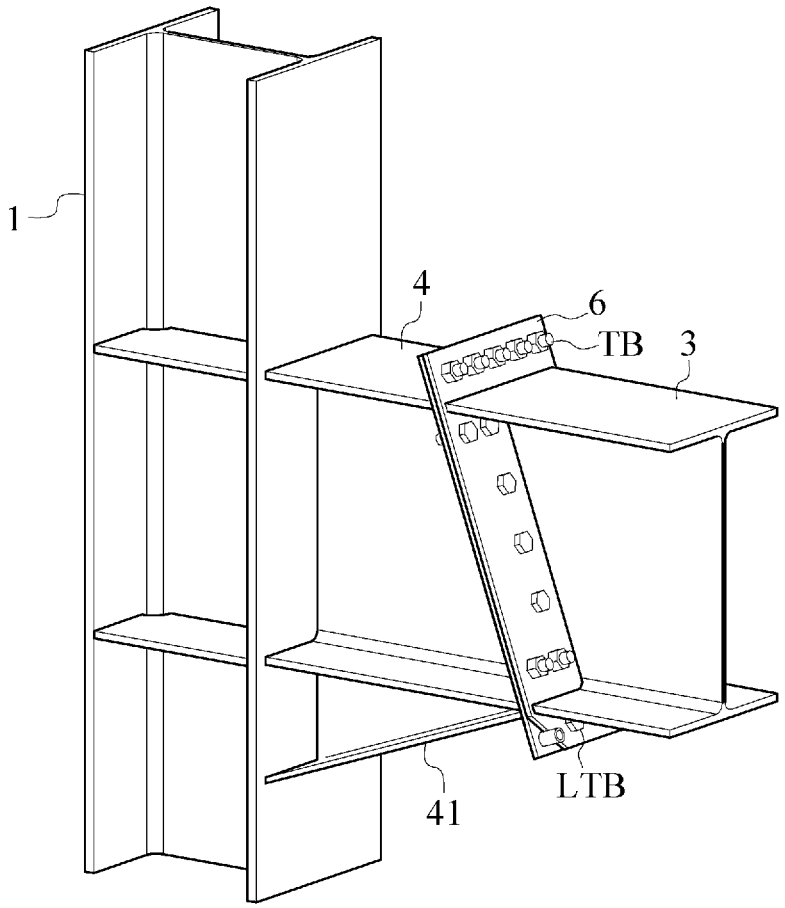
FIG. 5 is a perspective view showing the joint structure of steel beam according to the present invention, to which a haunch is coupled.

FIG. 3 is a perspective view showing a joint structure of steel beam according to the present invention, FIG. 4 is a perspective view showing steel beam connection in the joint structure of steel beam according to the present invention, and FIG. 5 is a perspective view showing the joint structure of steel beam according to the present invention, to which a haunch is coupled.

The present invention relates to a joint structure of steel beam for fixedly connecting a bracket 4 to the side surface of a column 1 or girder 2 and a steel beam 3 to the bracket 4 so that the steel beam 3 is connected to the side surface of the column 1 or girder 2.

FIGS. 3 to 5 show the embodiments of the present invention wherein the bracket 4 is connected to the side surface of the column 1, and FIGS. 11 to 16, as will be discussed later, show the embodiments of the present invention wherein the bracket 4 is connected to the side surface of the girder 2.

As shown in FIGS. 3 to 5, first, the joint structure of steel beam according to the present invention includes: the bracket 4 having one end coupled to the side surface of the column 1 or girder 2 and the other end whose lower portion formed slantly to an acute angle; a first connection plate 5 coupled to the slant end portion of the bracket 4 in such a manner as to protrude from the top of the bracket 4 by a given length; the steel beam 3 having one end whose lower portion formed slantly to an obtuse angle in such a manner as to correspond to the slant other end of the bracket; and a second connection plate 6 coupled to the slant end portion of the steel beam 3 in such a manner as to protrude from the top of the steel beam 3 by a given length, wherein each of the bracket 4 and the steel beam 3 has an upper flange, a lower flange and a web connecting the upper flange and the lower flange with each other, so that the bracket 4 and the steel beam 3 are connected to each other by fastening the first connection plate 5 and the second connection plate 6 to each other by means of tension bolts TB above and under the upper flanges of the bracket 4 and the steel beam 3.

That is, the first connection plate 5 and the second connection plate 6 protrude from the tops of the upper flanges of the bracket 4 and the steel beam 3, so that they are fastened to each other by means of the tension bolts TB above and under the upper flanges of the bracket 4 and the steel beam 3, thereby connecting the bracket 4 and the steel beam 3 to each other.

As a result, a moment between the bracket 4 and the steel beam 3 is transferred to each other, so that even at a portion at which the moment is large, the bracket 4 and the steel beam 3 can be freely connected to each other. Accordingly, the length of the bracket 4 can be freely adjusted to remove delivery and lifting loads caused by the increment in the length of the bracket 4.

Further, the connection surfaces between the bracket 4 and the steel beam 3 are obliquely formed, so that shear stress on the connection surfaces can be transferred well.

There is no need to transfer the shear stress by means of bolts, so that the design with only the tension bolts TB can be made, while the number of bolts needed is being remarkably reduced, thereby improving the economical effects and constructability thereof. Further, the bolts transfer only tension forces to allow bolt coupling holes to have free sizes, so that the manufacturing and construction errors generated upon the connection of the steel beam can be controlled through the bolt coupling holes.

Moreover, the sections of the bracket 4 and the steel beam 3 are slant to permit the first connection plate 5 and the second connection plate 6 to come into completely close contact with each other, so that precise construction can be achieved, without any separate reinforcement plates like shim plates for construction error compensation. In addition, there is no other member between the first connection plate 5 and the second connection plate 6, thereby stably transferring a bending moment therebetween.

Of course, the joint structure of steel beam according to the present invention may be applicable even to a Gerber joint.

Fastening the bracket 4 to the steel beam 3 is completed only by means of the tension bolts TB, which does not require any welding work in construction site.

Further, the steel beam 3 is connected to a portion having a lower bending moment when compared with the steel beam 3 is connected directly to the side surface of the column 1 or girder 2, so that the number of tension bolts TB can be greatly reduced, which improves the economical effects thereof.

The portions of the first connection plate 5 and the second connection plate 6 protruding from the tops of the bracket 4 and the steel beam 3 serve as shear connectors in such a manner as to be buried in slab concrete, which helps the steel beam 3 and the slab formed integrally with each other.

The bracket 4 is formed of an H beam.

If the bracket 4 is formed of the H beam, the bracket 4 can be easily connected to the H column 1 in any direction of strong and weak axes of the H column 1, and even if the girder 2 is formed of an H beam, the bracket 4 can be easily connected to the girder 2.

Figure 6:
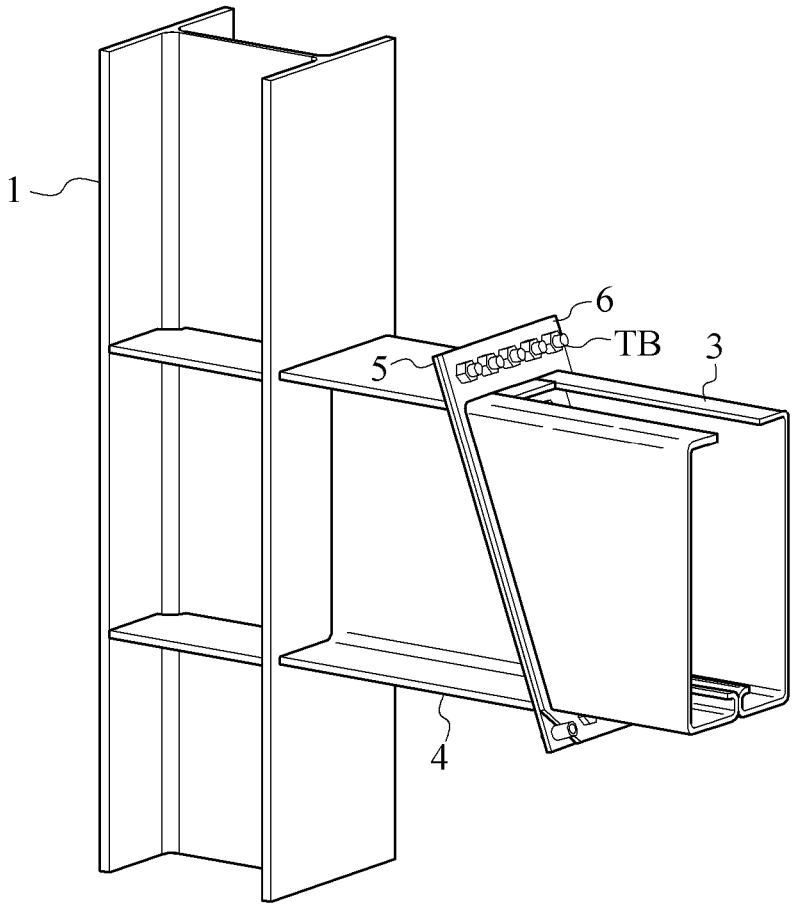
FIG. 6 is a perspective view showing an example wherein the steel beam adopted in the present invention is a TSC (T-type Steel Concrete) composite beam which is made by bending steel plates to charge concrete into the bent steel plates.
Figure 7:
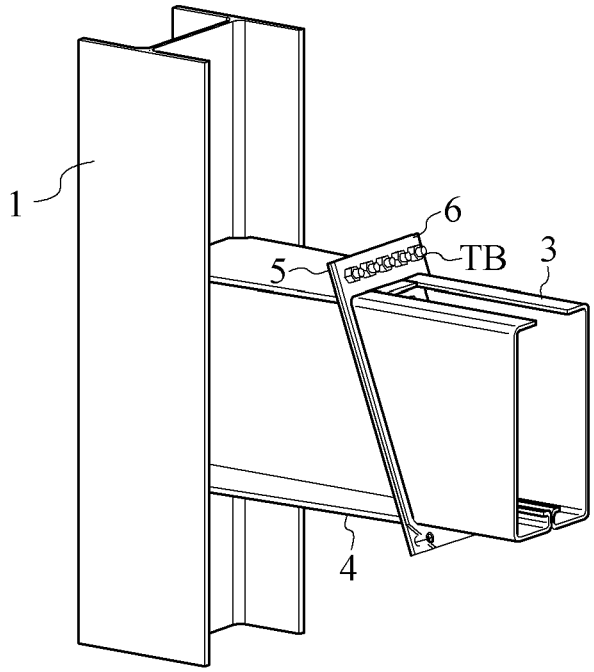
FIGS. 7*a* and 7*b* are perspective and top views showing the connected state of the steel beam adopted in the present invention to the web of the steel column.
Figure 7:
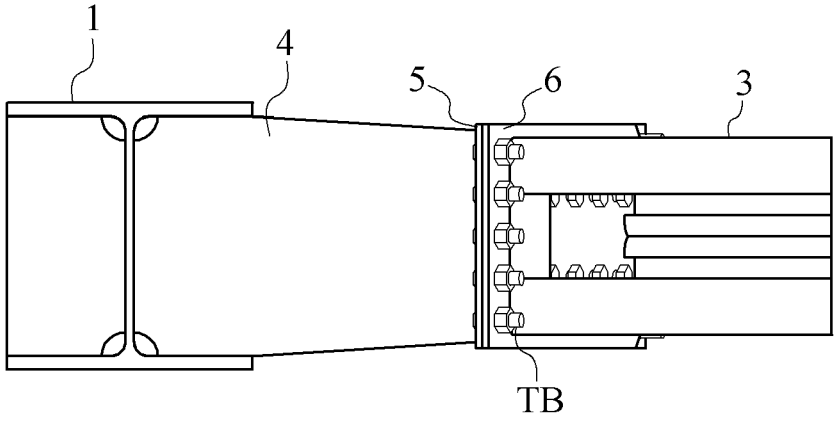

As shown in FIGS. 3 to 5, the steel beam 3 may be formed of the H beam, or as shown in FIGS. 6 to 7*b*, the steel beam 3 may be formed of a composite beam made by bending steel plates to charge concrete into the bent steel plates.

Tension bolts LTB for lateral force resistance are fastened to the lower portions of the first connection plate 5 and the second connection plate 6.

If a lateral force is applied, a tensile force may be generated even from the lower portions of the first connection plate 5 and the second connection plate 6. If the lateral force is applied, accordingly, the tension bolts TB are fastened on the upper portions of the first connection plate 5 and the second connection plate 6, and the tension bolts LTB for lateral force resistance are fastened on the lower portions of the first connection plate 5 and the second connection plate 6.

According to the embodiment of the present invention, as shown in FIG. 3, the first connection plate 5 and the second connection plate 6 are fastened to each other by means of the tension bolts TB above and under the upper flanges of the bracket 4 and the steel beam 3, and they are fastened to each other by means of the tension bolts LTB for lateral force resistance above and under the lower flanges of the bracket 4 and the steel beam 3, while the remaining portions of the first connection plate 5 and the second connection plate 6 are being fastened to each other by means of bolts B if necessary.

FIG. 4 shows the connection of the steel beam 3 to the bracket 4, and as shown in FIG. 4, the slant surface of the second connection plate 6 coupled to the steel beam 3 slides obliquely along the first connection plate 5 slantly coupled to the bracket 4, so that the steel beam 3 can be connected to the bracket 4.

Further, as shown in FIG. 5, a haunch 41 is coupled to the underside of the bracket 4 so as to conduct shear reinforcement.

FIG. 6 is a perspective view showing an example wherein the steel beam adopted in the present invention is a TSC composite beam which is made by bending steel plates to charge concrete into the bent steel plates.

As shown in FIG. 6, the TSC composite beam (as disclosed in Korean Patent No. 10-0430317), which bends steel plates in such a manner as to allow the top of the beam to be open to charge concrete into the beam, thereby permitting the beam to be formed integrally with a slab, is used as the steel beam 3 adopted in the present invention.

The TSC composite beam advantageously enhances the tensile force and reduces the quantity of steel used.

FIGS. 7*a* and 7*b* are perspective and top views showing the connected state of the steel beam adopted in the present invention to the web of the column.

The steel beam 3 is connected to the outside of the flange of the column 1 according to the embodiment of the present invention as shown in FIGS. 3 to 6, but the steel beam 3 is connected to the side surface of the web of the column 1 according to the embodiment of the present invention as shown in FIGS. 7*a* and 7*b*.

As shown in FIG. 7*b*, in this case, the widths of the upper and lower flanges of the bracket 4 may be tapered according to the height of the web of the column 1 and the width of the steel beam 3.

Figure 8:
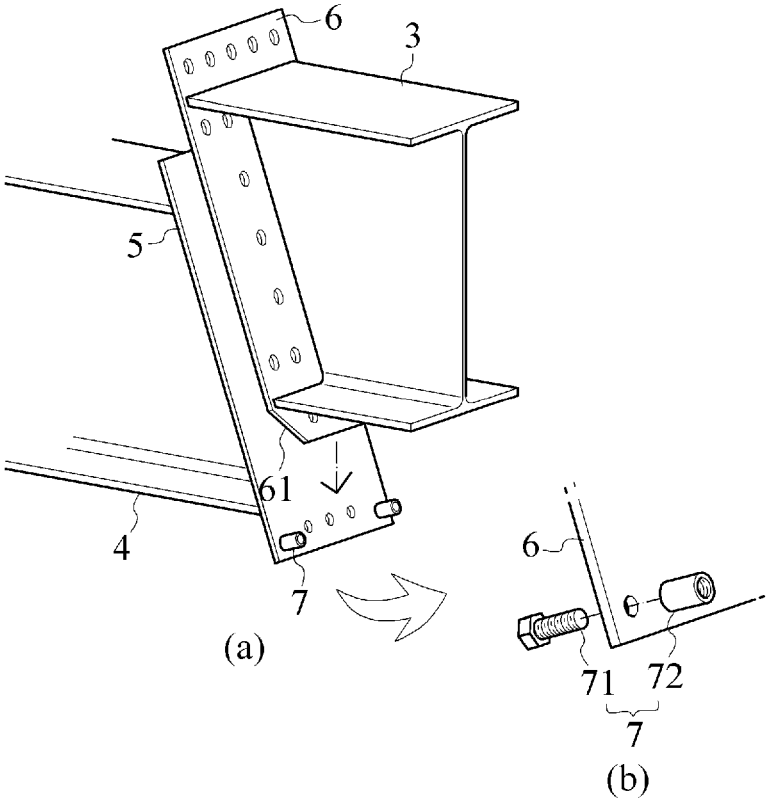
FIGS. 8*a* and 8*b* are perspective views showing an example of the guide parts adopted in the present invention.
Figure 9:
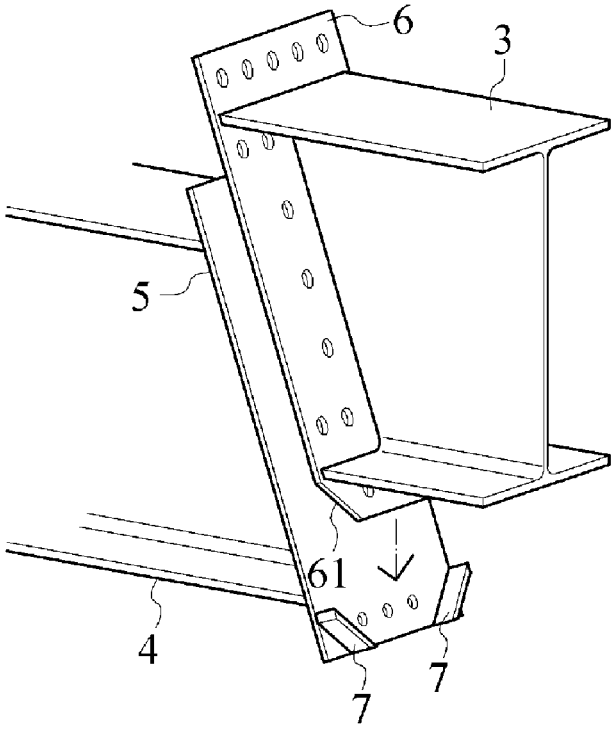
FIG. 9 is a perspective view showing another example of the guide parts adopted in the present invention.

FIGS. 8*a* and 8*b* are perspective views showing an example of the guide parts adopted in the present invention, and FIG. 9 is a perspective view showing another example of the guide parts adopted in the present invention.

As shown in FIGS. 3 and 4, a pair of guide parts 7 protrude from the steel beam side lower portion of the first connection plate 5 in such a manner as to be spaced apart from each other, and chamfered portions 61 are formed on both sides of the lower end of the second connection plate 6 in such a manner as to allow the lower end of the second connection plate 6 to be inserted into the pair of guide parts 7.

The guide parts 7 and the chamfered portions 61 serve to accurately guide the connected positions between the bracket 4 and the steel beam 3 upon the construction, so that the formation of the guide parts 7 prevents the steel beam 3 from being deviated to left and right sides from the bracket 4 and allows the steel beam 3 to be maintained horizontally upon the downward movement of the steel beam 3. The chamfered portions 61 are locked onto the top peripheries of the guide parts 7, thereby permitting the steel beam 3 to be fixedly connected to the bracket 4.

At this time, as shown in FIGS. 8*a* and 8*b*, each guide part 7 includes a bolt member 71 coupled to the rear surface of the first connection plate 5 in such a manner as to protrude from the front surface of the first connection plate 5 and a pipe member 72 having a screw thread formed at the inside thereof in such a manner as to be screw-coupled to the protruding portion of the bolt member 71.

Further, as shown in FIG. 9, the guide parts 7 are formed of plates coupled to the corners of the lower portion of the front surface of the first connection plate 5 in such a manner as to be inclined inwardly toward the lower portion thereof to correspond to the chamfered portions 61 of the lower end of the second connection plate 6.

Figure 10:
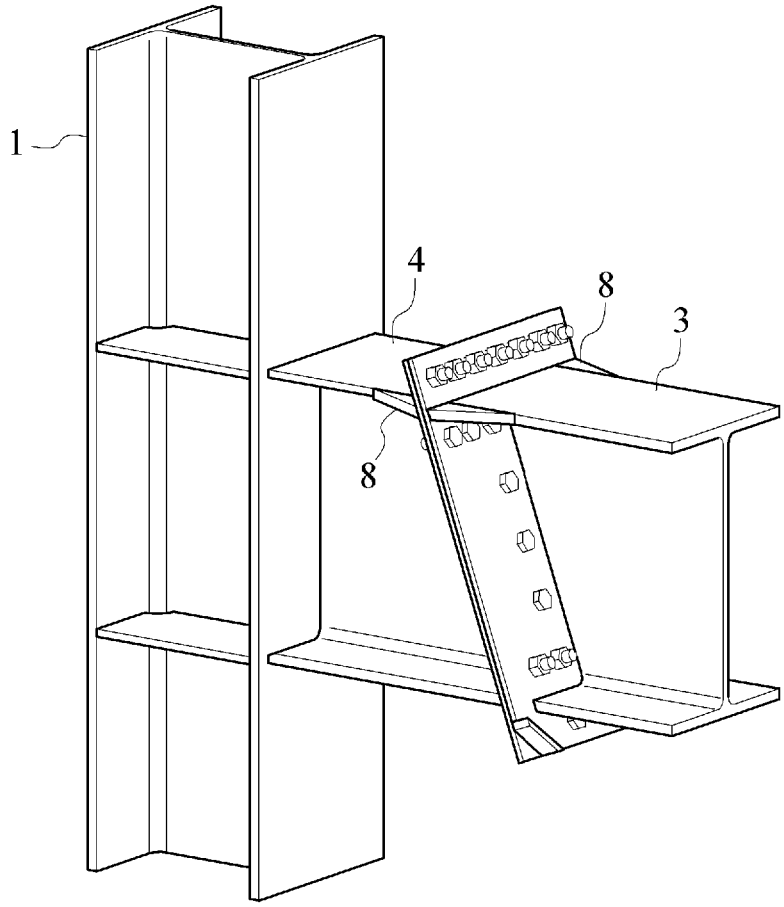
FIG. 10 is a perspective view showing reinforcement plates adopted in the present invention.
Figure 11:
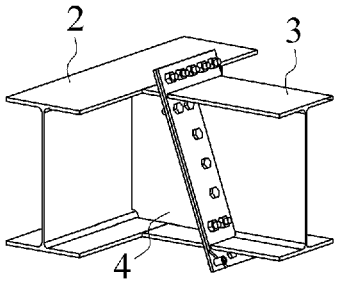
FIGS. 11*a* to 11*e* are perspective views showing joint structure of steel beam according to various embodiments of the present invention.
Figure 11:
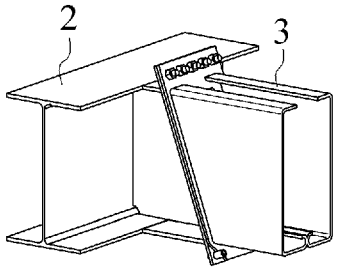
Figure 11:
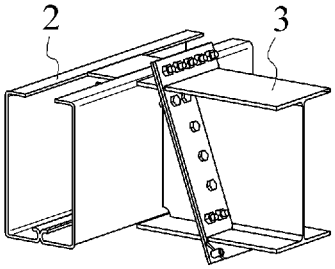
Figure 11:
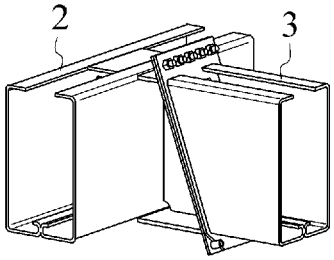
Figure 11:
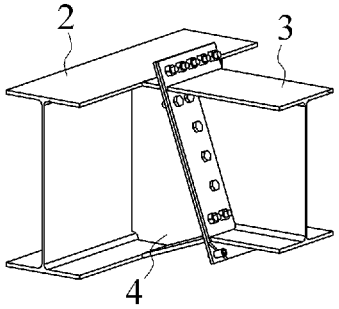

FIG. 10 is a perspective view showing reinforcement plates adopted in the present invention.

As shown in FIG. 10, the first connection plate 5 and the second connection plate 6 protrude from the sides of the bracket 4 and the steel beam 3 by a given length, and reinforcement plates 8 are coupled to the spaces between the sides of the upper flanges of the bracket 4 and the steel beam 3 and the protruding portions of the first connection plate 5 and the second connection plate 6 from the sides of the bracket 4 and the steel beam 3.

The reinforcement plates 8 serve to transfer the moments of the upper flanges.

The reinforcement plates 8 are coupled to the spaces between the sides of the upper flange of the bracket 4 and the protruding portions of the first connection plate 5 from the sides of the bracket 4 and also coupled to the spaces between the sides of the upper flange of the steel beam 3 and the protruding portions of the second connection plate 6 from the sides of the steel beam 3.

FIGS. 11*a* to 11*e* are perspective views showing joint structure of steel beam according to various embodiments of the present invention.

FIGS. 3 to 10 show various steel beam coupling structures to the steel column 1, but FIGS. 11*a* to 11*e* show various embodiments of the steel beam coupling structures to the girder 2.

FIG. 11*a* shows an H beam 3 coupled to an H girder 2, and FIG. 11*b* shows a TSC beam 3 coupled to an H girder 2.

FIG. 11*c* shows an H beam 3 coupled to a TSC girder 2, FIG. 11*d* shows a TSC beam 3 coupled to a TSC girder 2, and FIG. 11*e* shows an H beam 3 coupled to an H deep girder 2.

FIGS. 12*a* and 12*b* are perspective views showing various examples wherein a bracket is passed through an H girder in the joint structure of steel beam according to the present invention, and FIGS. 13*a* and 13*b* are perspective views showing an example wherein a bracket is passed through an H girder in such a manner as to protrude from the underside of the girder in the joint structure of steel beam according to the present invention.

As shown in FIGS. 12*a* to 13*b*, the bracket 4 is passed through the girder 2.

In this case, the lower portions of both ends of the bracket 4 are inclined to an acute angle.

FIGS. 12*a* and 12*b* show examples wherein the bracket 4 is passed through an H girder 2, wherein a penetration portion 21 is formed on the web of the girder 2 to pass the bracket 4 through the girder 2, as shown in FIG. 12*b*.

FIGS. 13*a* and 13*b* show examples wherein the bracket 4 is passed through an H girder 2 in such a manner as to allow a portion of the lower portion of the bracket 4 to protrude from the underside of the girder 2, wherein a penetration portions 21 is formed on the web of the girder 2 to pass a portion of the upper portion of the bracket 4 through the girder 2 and on the lower flange of the girder 2 to pass a portion of the lower portion of the bracket 4 through the girder 2, as shown in FIG. 13*b*.

FIGS. 14*a* and 14*b* are perspective views showing an example wherein a bracket is passed through a TSC beam in the joint structure of steel beam according to the present invention, and FIGS. 15*a* and 15*b* are perspective views showing an example wherein a bracket is passed through a TSC beam in such a manner as to protrude from the underside of the beam in the joint structure of steel beam according to the present invention.

As shown in FIGS. 14*a* to 15*b*, a bracket 4 is passed through a girder 2 as a TSC beam.

FIGS. 14*a* and 14*b* show an example wherein the bracket 4 is passed through the TSC beam 2, wherein a penetration portion 21 is formed on the web of the TSC beam 2 to pass the bracket 4 through the TSC beam 2, as shown in FIG. 14*b*.

FIGS. 15*a* and 15*b* show an example wherein the bracket 4 is passed through the TSC beam 2 in such a manner as to allow the lower portion of the bracket 4 to protrude from the underside of the TSC beam 2, wherein a penetration portion 21 is formed on the web of the TSC beam 2 to pass a portion of the upper portion of the bracket 4 through the TSC beam 2 and on the lower flange of the TSC beam 2 to pass the lower portion of the bracket 4 through the TSC beam 2, as shown in FIG. 15*b*.

FIGS. 16*a* and 16*b* are perspective views showing an example wherein a TSC beam is insertedly mounted into a bracket in the joint structure of steel beam according to the present invention.

FIGS. 16*a* and 16*b* show the example wherein the TSC beam 2 is inserted mounted into the bracket 4, wherein a beam seating recess 42 is formed in the bracket 4 in such a manner as to fit the lower portion of the TSC beam 2 thereto.

At this time, as shown in FIG. 16*b*, a load transmission plate 22 is coupled to the interior of the girder 2 as the TSC beam to transfer the load of the upper flange of the bracket 4.

FIGS. 17*a* and 17*b* are perspective views showing an example wherein a bracket is passed through an H girder in the joint structure of steel beam according to the present invention.

Figure 12:
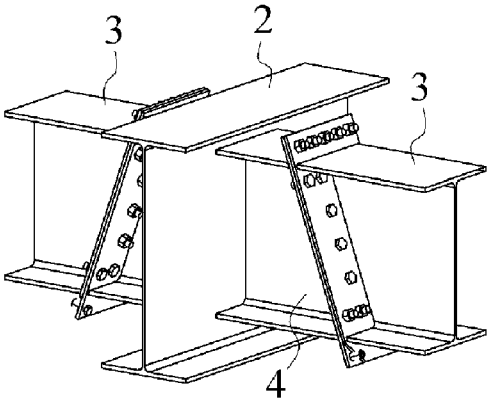
FIGS. 12*a* and 12*b* are perspective views showing various examples wherein a bracket is passed through an H girder in the joint structure of steel beam according to the present invention.
Figure 12:
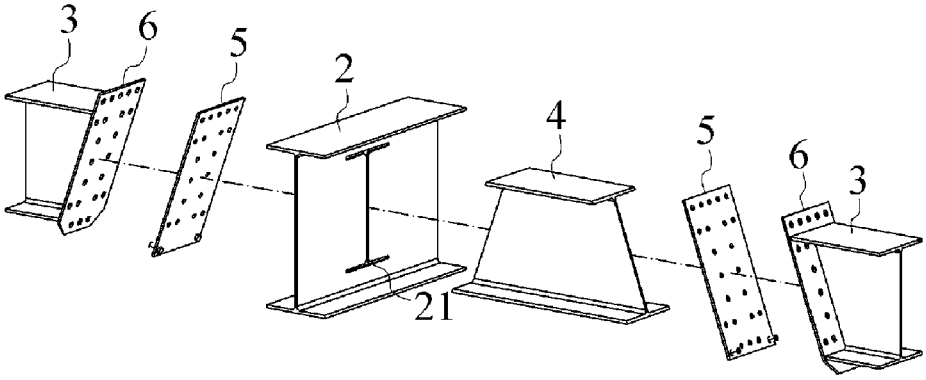
Figure 13:
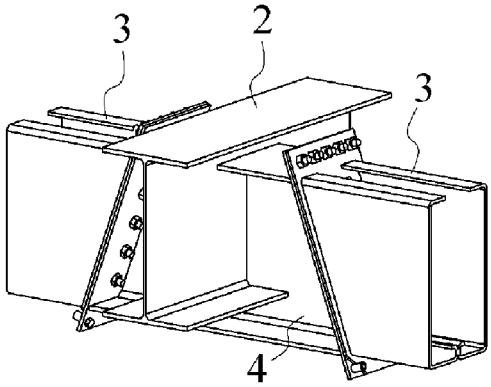
FIGS. 13*a* and 13*b* are perspective views showing an example wherein a bracket is passed through an H girder in such a manner as to protrude from the underside of the girder in the joint structure of steel beam according to the present invention.
Figure 13:
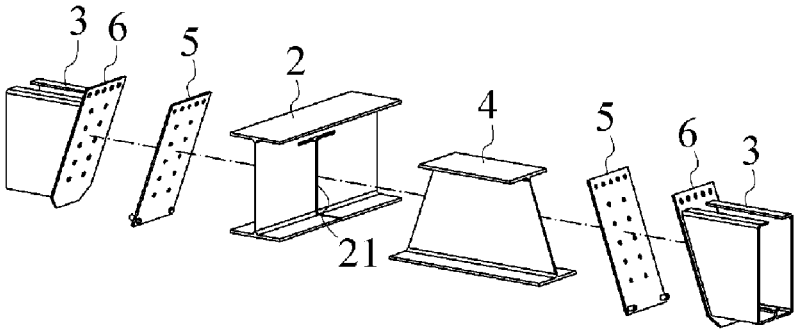
Figure 14:
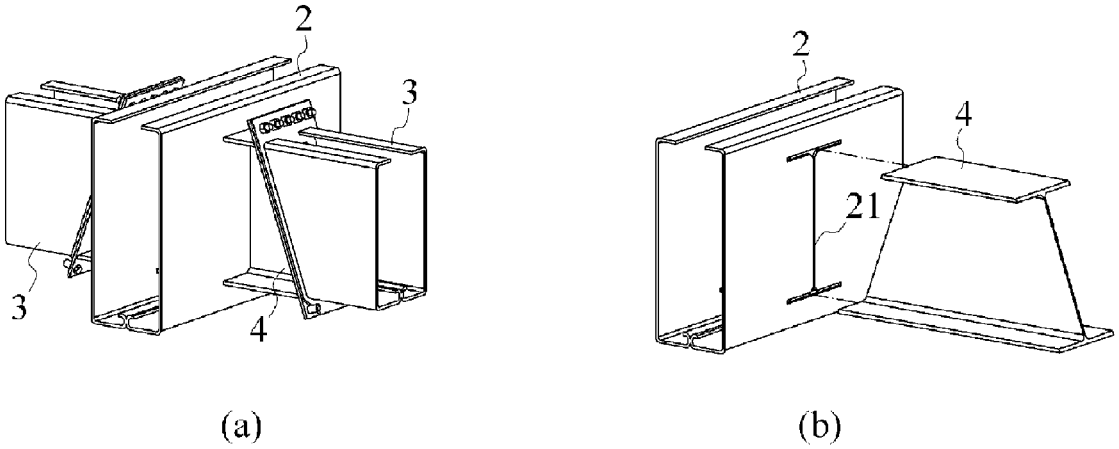
FIGS. 14*a* and 14*b* are perspective views showing an example wherein a bracket is passed through a TSC beam in the joint structure of steel beam according to the present invention.
Figure 15:
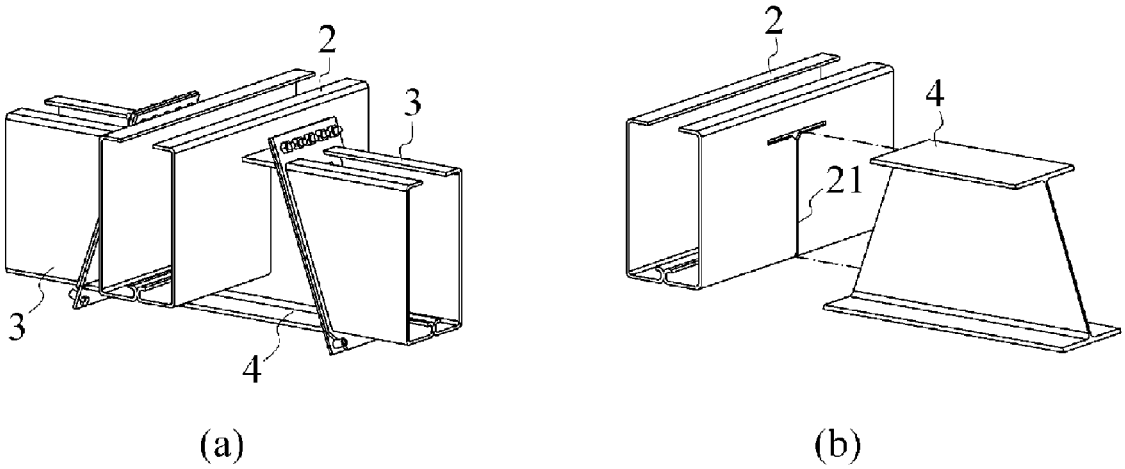
FIGS. 15*a* and 15*b* are perspective views showing an example wherein a bracket is passed through a TSC beam in such a manner as to protrude from the underside of the beam in the joint structure of steel beam according to the present invention.
Figure 16:
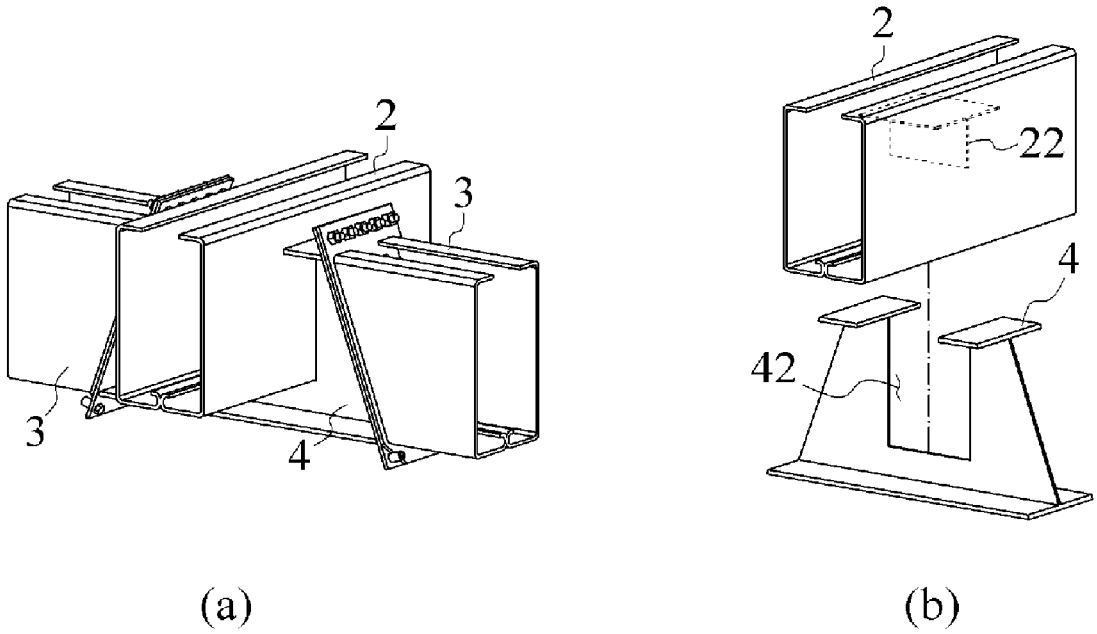
FIGS. 16*a* and 16*b* are perspective views showing an example wherein a TSC beam is passed through a bracket in the joint structure of steel beam according to the present invention.
Figure 17:
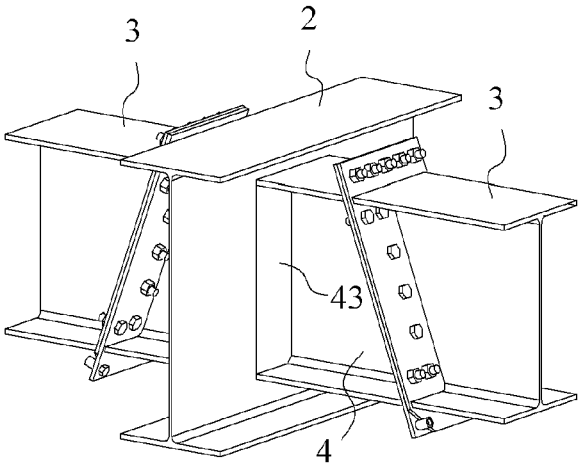
FIGS. 17*a* and 17*b* are perspective views showing an example wherein a bracket is passed through an H girder in the joint structure of steel beam according to the present invention.
Figure 17:
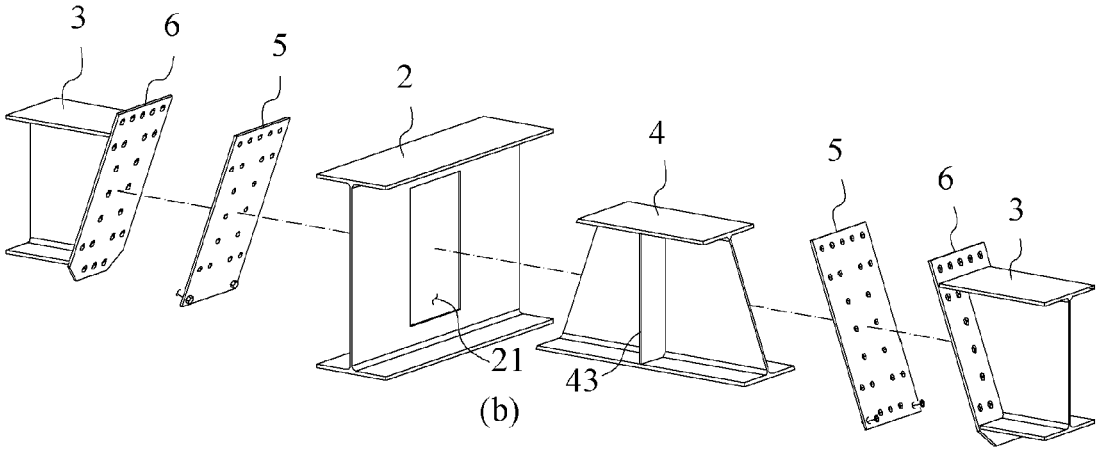

The penetration portion 21 has the same shape as the bracket 4 in the embodiment of the present invention as shown in FIG. 12, but the penetration portion 21 is formed to a shape of a rectangle as shown in FIG. 17 so that the bracket 4 can be easily coupled to the H girder 2.

In this case, the bracket 4 has a blocking plate 43 disposed between the upper and lower flanges thereof to block the penetration portion 21.

Figure 18:
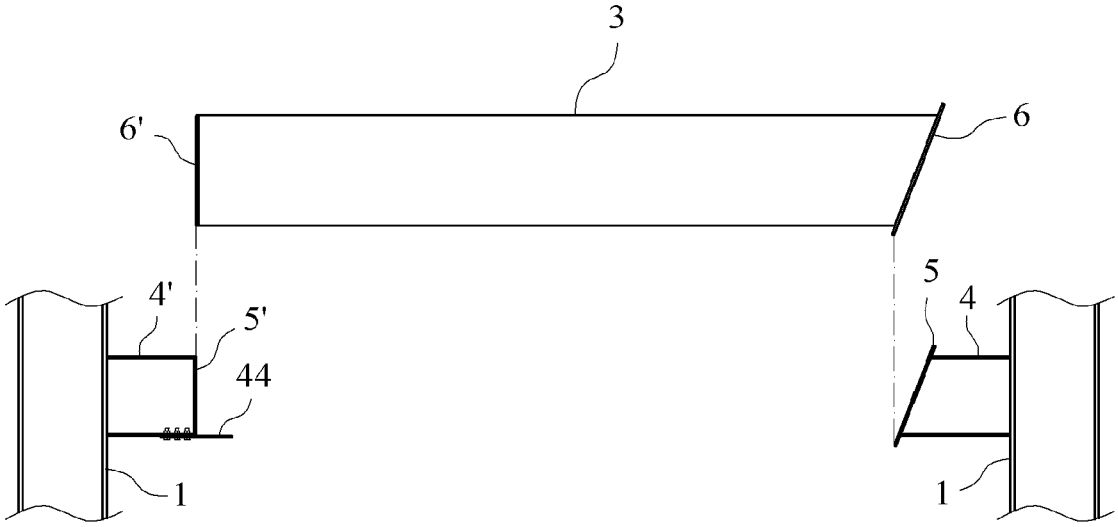
FIGS. 18*a* and 18*b* are side views showing an example wherein a steel beam having one side slant and the other side vertical is coupled to a bracket in the joint structure of steel beam according to the present invention.
Figure 18:
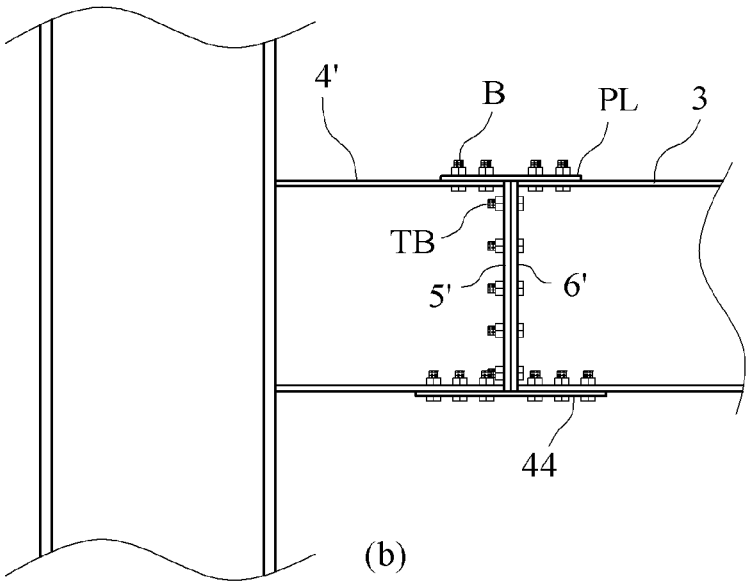

FIG. 18*a* is a side view showing an example wherein a steel beam 3 having one side slant and the other side vertical is connected to brackets 4 and 4' coupled to columns 1, and FIG. 18*b* is an enlarged view showing the coupled portion between the vertical end portion of the steel beam 3 and the bracket 4'.

As shown in FIG. 18*a*, one end of the steel beam 3 is formed slantly and the other end thereof is formed vertically, so that the brackets 4 and 4' may be coupled correspondingly to both sides of the steel beam 3.

Even in this case, one end of the steel beam 3 is formed slantly, so that the manufacturing and construction errors of the steel beam 3 can be effectively removed to improve the constructability.

The bracket 4' has a base plate 44 previously coupled to the underside of the end portion thereof to fix the coupled position of the steel beam 3 thereto, and the base plate 4 is coupled to the lower flange of the steel beam 3 by means of bolts B after the steel beam 3 is seated thereon.

As shown in FIG. 18*b*, a first connection plate 5' is connected to the end portion of the bracket 4' coupled to the vertical end portion of the steel beam 3, and a second connection plate 6' is connected to the end portion of the steel beam 3, so that the first connection plate 5' and the second connection plate 6' are fastened to each other by means of tension bolts TB.

In the same manner as the conventional practice, at this time, splice plates PL are fastened to the top surfaces of the upper flanges and the underside surfaces of the lower flanges by means of bolts B, but since the first connection plate 5' and the second connection plate 6' are fastened to each other by means of the tension bolts TB, the number of bolts B used is smaller than that used in case of the conventional connection using only the slice plates PL and the bolts B.

Figure 19:
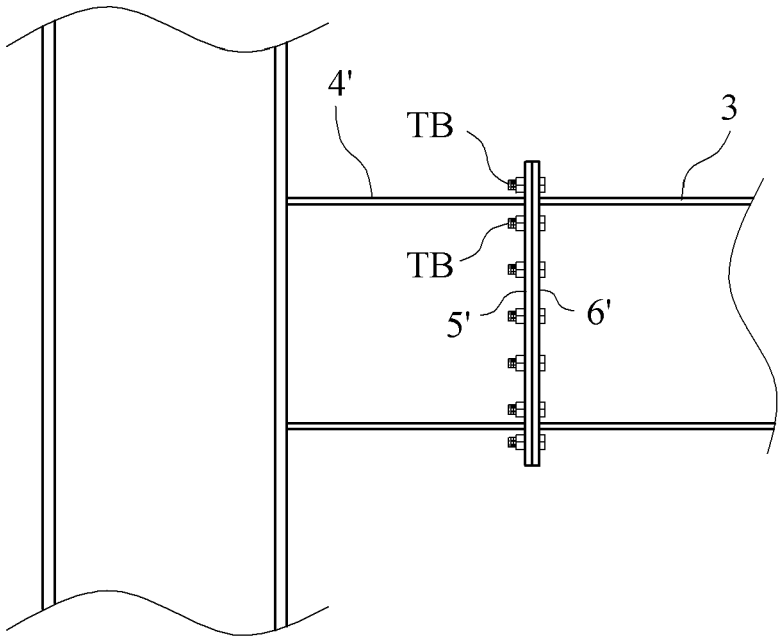
FIG. 19 is a side view showing another example of the vertical end connection of the steel beam in the joint structure of steel beam according to the present invention.

FIG. 19 is a side view showing another example of the vertical end connection of the steel beam 3.

As shown in FIG. 19, the first connection plate 5' of the bracket 4' and the second connection plate 6' of the steel beam 3 are fastened to each other by means of only the tension bolts TB, without any slice plates PL.

INDUSTRIAL APPLICABILITY

The joint structure of steel beam of the present invention is configured wherein the first connection plate and the second connection plate are connected correspondingly to the end portions of the bracket and the steel beam and then fastened to each other by means of the tension bolts above and under the upper flanges of the bracket and the steel beam, so that the shear force on the connection surfaces between the steel beam and the bracket can be effectively transferred, thereby reducing the number of bolts for the connection, improving economical effects and constructability thereof, shortening the period of construction thereof, and preventing occurrence of a machining cost because no additional welding is carried out in construction site.

What is claimed is:

1. A joint structure of steel beam for fixedly connecting a bracket to a side surface of a column or girder and a steel beam to the bracket so that the steel beam is connected to the side surface of the column or girder, the joint structure of steel beam comprising:

the bracket having one end coupled to the side surface of the column or girder and other end whose lower portion formed slantly to an acute angle;

a first connection plate coupled to a slant end portion of the bracket in such a manner as to protrude from a top of the bracket by a first length;

the steel beam having one end whose lower portion formed slantly to an obtuse angle in such a manner as to correspond to the slant other end of the bracket; and a second connection plate coupled to a slant end portion of the steel beam in such a manner as to protrude from a top of the steel beam by a second length, wherein the first connection plate has a pair of guide parts protruding from a steel beam side lower portion thereof in such a manner as to be spaced apart from each other, and the second connection plate has chamfered portions formed on both sides of the lower end thereof in such a manner as to allow a lower end thereof to be inserted into the pair of guide parts, wherein each of the bracket and the steel beam has an upper flange, a lower flange and a web connecting the upper flange and the lower flange with each other, so that the bracket and the steel beam are connected to each other by fastening the first connection plate and the second connection plate to each other by means of tension bolts above and under the upper flanges of the bracket and the steel beam to transfer tension forces between the upper flanges, and wherein each guide part comprises a bolt member coupled to a rear surface of the first connection plate in such a manner as to protrude from a front surface of the first connection plate and a pipe member having a screw thread formed at an inside thereof in such a manner as to be screw-coupled to a protruding portion of the bolt member.

2. The joint structure of steel beam according to claim 1, wherein the steel beam is an H beam or a composite beam made by bending steel plates to charge concrete into the bent steel plates.

3. The joint structure of steel beam according to claim 1, wherein lower portions of the first connection plate and the second connection plate are fastened to each other by means of further tension bolts for lateral force resistance.

4. The joint structure of steel beam according to claim 1, wherein the guide parts are formed of plates coupled to corners of a lower portion of the front surface of the first connection plate in such a manner as to be inclined inwardly toward the lower portion thereof to correspond to the chamfered portions of the lower end of the second connection plate.

5. The joint structure of steel beam according to claim 1, wherein the first connection plate and the second connection plate protrude from sides of the bracket and the steel beam by the first length and the second length, and reinforcement plates are coupled to spaces between sides of the upper flanges of the bracket and the steel beam and protruding portions of the first connection plate and the second connection plate from the sides of the bracket and the steel beam.

6. The joint structure of steel beam according to claim 1, wherein the bracket is an H beam.

7. The joint structure of steel beam according to claim 6, wherein the steel beam is an H beam or a composite beam made by bending steel plates to charge concrete into the bent steel plates.

* * * * *